US006837680B2

(12) United States Patent
Kamiya et al.

(10) Patent No.: US 6,837,680 B2
(45) Date of Patent: Jan. 4, 2005

(54) CENTRIFUGAL BLOWER HAVING CENTRIFUGAL FAN ARRANGED IN SCROLL CASING

(75) Inventors: Toshifumi Kamiya, Takahama (JP); Shinji Aoki, Chiryu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/425,887

(22) Filed: Apr. 28, 2003

(65) Prior Publication Data

US 2003/0202877 A1 Oct. 30, 2003

(30) Foreign Application Priority Data

Apr. 30, 2002 (JP) ..... 2002-127928

(51) Int. Cl.[7] ..... F01D 3/00
(52) U.S. Cl. ..... 415/206; 415/12.1; 415/119
(58) Field of Search ..... 415/206, 204.2, 415/12.1, 208.1, 119, 211.1, 211.2, 205, 207

(56) References Cited

U.S. PATENT DOCUMENTS 353,994 A * 12/1886 Walker ..... 415/148
3,687,360 A * 8/1972 Prew et al. ..... 494/85
5,839,879 A 11/1998 Kameoka et al.
6,200,093 B1 * 3/2001 Lee et al. ..... 415/204
6,254,336 B1 * 7/2001 Ahn ..... 415/119

FOREIGN PATENT DOCUMENTS

JP 10-196596 7/1998

* cited by examiner

*Primary Examiner*—Edward K. Look
*Assistant Examiner*—James M. McAleenan
(74) *Attorney, Agent, or Firm*—Harness, Dickey & Pierce, PLC

(57) ABSTRACT

An inner surface of a peripheral wall of a scroll casing includes an initial section, which extends from a circumferentially projected end of a nose. The initial section includes a slant surface. The slant surface is angled relative to a rotational axis of a fan such that an axially remote part of the slant surface, which is axially remote from an air inlet of the scroll casing, is radially closer to blades of the fan in comparison to an axially less remote part of the slant surface, which is axially less remote from the air inlet in comparison to the axially remote part.

13 Claims, 7 Drawing Sheets

CENTRIFUGAL BLOWER HAVING CENTRIFUGAL FAN ARRANGED IN SCROLL CASING

CROSS REFERENCE TO RELATED APPLICATION

This application is based on and incorporates herein by reference Japanese Patent Application No. 2002-127928 filed on Apr. 30, 2002.

BACKGROUND OF THE INVENTION

1. Field of the Invention

The present invention relates to a centrifugal blower, which has a centrifugal fan arranged in a scroll casing.

2. Description of Related Art

For example, Japanese Unexamined Patent Publication No. 10-196596 discloses a centrifugal blower shown in FIG. 10.

With reference to FIG. 10, the prior art centrifugal blower 101 has a centrifugal fan 110 arranged in a scroll casing 120. The centrifugal fan 110 includes a plurality of blades 111 arranged along a circle and is rotated by a motor (not shown). Upon rotation of the motor, the centrifugal fan 110 axially draws air through an air inlet 124 of the scroll casing 120 located at one axial end (axial end located on the back side of the sheet of FIG. 10) of the centrifugal fan 110 and then radially outwardly blows the drawn air. The scroll casing 120 forms a scroll air passage 126 around the centrifugal fan 110. The scroll air passage 126 extends from a nose 127 of the scroll casing 120, which serves as an initial point of the scroll air passage 126. A protrusion 123*a* is formed at the air inlet 124 to partially cover the air inlet 124.

At the nose 127, which serves as the initial point of the scroll air passage 126, an inner cylindrical surface 121 of an outer peripheral wall (a cylindrical wall that extends in the axial direction of the centrifugal fan 110) of the scroll casing 120 is in close proximity to a radially outer end of a corresponding one of the blades 111 of the centrifugal fan 110. Thus, a relatively large pressure is developed in that region. When the pressure in this region is increased, reverse airflow, which flows toward the air inlet 124, tends to occur. The protrusion 123*a* is provided to restrain escape of the reverse airflow through the air inlet 124.

In recent years, considerable efforts have been devoted to reducing a size of such a centrifugal blower, and it has been found that the reduction of the size of the centrifugal blower generally causes an increase in annoying siren-like noises in the centrifugal blower although the reverse airflow does not substantially escape through the air inlet. The siren-like noises are generated when the air radially outwardly discharged from the centrifugal fan impinges against the opposed inner cylindrical surface of the outer peripheral wall of the scroll casing.

FIG. 11 schematically shows the region around the nose 127 of the centrifugal blower 101. When the centrifugal fan 110 is rotated by the motor (not shown), the air drawn through the air inlet 124 is radially outwardly blown by the corresponding blade 111. Each time the respective blade 111 passes the nose 127, the air blown by the blade 111 impinges against the inner cylindrical surface 121 of the scroll casing 120 and generates the siren-like noises.

Lately, throughout extensive efforts, the inventors of the present invention have found that velocities of airflow components of the airflow, which is radially outwardly blown by the corresponding blade 11, differ from one another along a direction parallel to the rotational axis of the centrifugal fan 110, as indicated by blank arrows in FIG. 11.

When the air inlet 124 is arranged adjacent to the lower axial end of the centrifugal fan 110, as shown in FIG. 11, the velocity of the upper airflow component, which is located at the upper side of the centrifugal fan 110, is generally greater than the velocity of the lower airflow component, which is located at the lower side of the centrifugal fan 110, as shown in FIG. 11. Time of impingement of the upper airflow component against the inner cylindrical surface 121 of the scroll casing 120 is slightly faster than time of impingement of the lower airflow component against the inner cylindrical surface 121 of the scroll casing 120. However, a time difference between the time of impingement of the upper airflow component against the inner cylindrical surface 121 and the time of impingement of the lower airflow component against the inner cylindrical surface 121 is relatively small and insignificant. Furthermore, in a case of a small fan, particularly one that has a narrow nose gap, the velocity of the airflow at the time of impingement against the inner cylindrical surface is relatively high, causing generation of relatively large noises.

The noises, which are generated at the time of impingement of the airflow against the inner cylindrical surface 121, occur every time the respective blade 111 passes the nose 127, resulting in siren-like noises.

SUMMARY OF THE INVENTION

The present invention addresses the above disadvantage. Thus, it is an objective of the present invention to provide a compact centrifugal blower, which is capable of minimizing noises generated upon impingement of airflow blown by a centrifugal fan of the centrifugal blower.

To achieve the objective of the present invention, there is provided a centrifugal blower that includes a centrifugal fan, a motor and a scroll casing. The centrifugal fan has a plurality of blades, which are generally arranged along a circle. The centrifugal fan axially draws air and radially blows the drawn air. The motor rotates the centrifugal fan. The scroll casing surrounds the centrifugal fan and includes an air inlet and a scroll air passage. The air inlet is arranged adjacent to one axial end of the centrifugal fan to supply air to the centrifugal fan. The scroll air passage extends around the centrifugal fan along an inner surface of a peripheral wall of the scroll casing. A nose, which is formed in the inner surface of the peripheral wall and projects in a circumferential direction opposite to a rotational direction of the centrifugal fan, forms an initial point of the scroll air passage. The inner surface of the peripheral wall includes an initial section, which extends from a circumferentially projected end of the nose. The initial section of the inner surface includes a first surface part and a second surface part. The first surface part receives and guides a first airflow component of airflow that is radially blown by a corresponding one of the blades. The first airflow component has a first velocity. The second surface part receives and guides a second airflow component of the airflow that is radially blown by the corresponding one of the blades. The second airflow component has a second velocity that is smaller than the first velocity. The first surface part and the second surface part at least partially overlap with each other in a direction generally parallel to a rotational axis of the centrifugal fan. The first surface part is radially closer to the blades in comparison to the second surface part.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

(First Embodiment)

Figure 1:
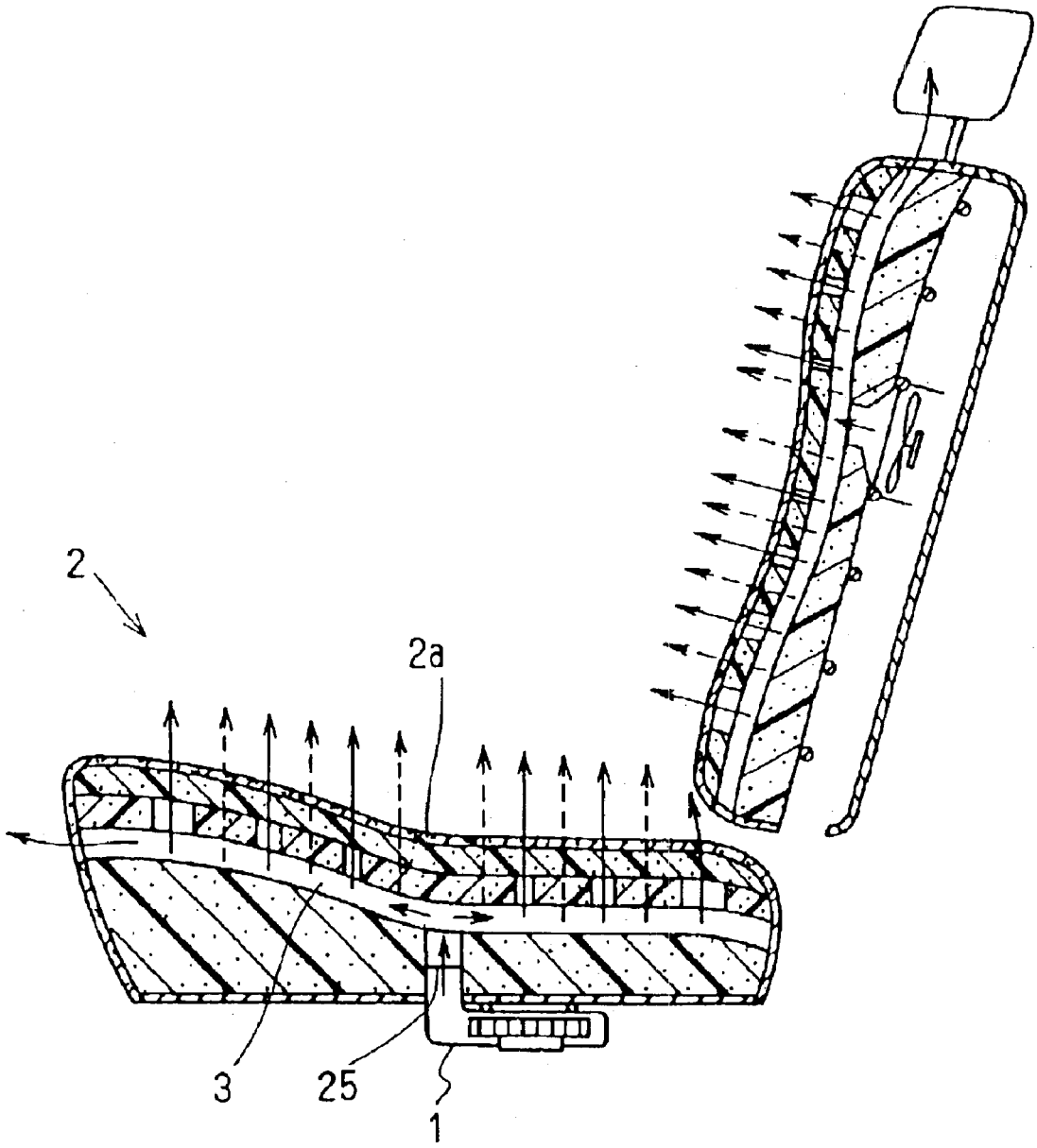
FIG. 1 is a schematic cross sectional view of a vehicle seat air conditioning system having a centrifugal blower according to a first embodiment of the present invention.

A centrifugal blower according to a first embodiment of the present invention is a blower of a static pressure type, which is capable of blowing air even when a structure, which is connected to the blower on a downstream side of the blower, losses the relatively large amount of pressure. The centrifugal blower (hereinafter, simply referred to as a blower) 1 is suitable for a vehicle seat air conditioning system, such as one shown in FIG. 1. As shown in FIG. 1, the blower 1 is arranged below a seat 2. An air passage 3 is formed in the seat 2 to conduct air blown from an air outlet 25 of the blower 1. Details of the seat 2, such as details of an air passage constituting member of the air passage 3, details of a seat reinforcing member and the like, are not illustrated in FIG. 1 for the sake of simplicity.

Air conducted through the air passage 3 is blown through small through holes of a seat cover 2*a*, which forms a top seat surface and a backrest surface of the seat 2, to supply conditioned air to a user seated on the seat 2. In the present embodiment, after the air is blown by the blower 1 through the small through holes of the cover 2*a*, the air is heated to an appropriate temperature by a heating means (not shown) arranged in the seat 2.

Figure 2:
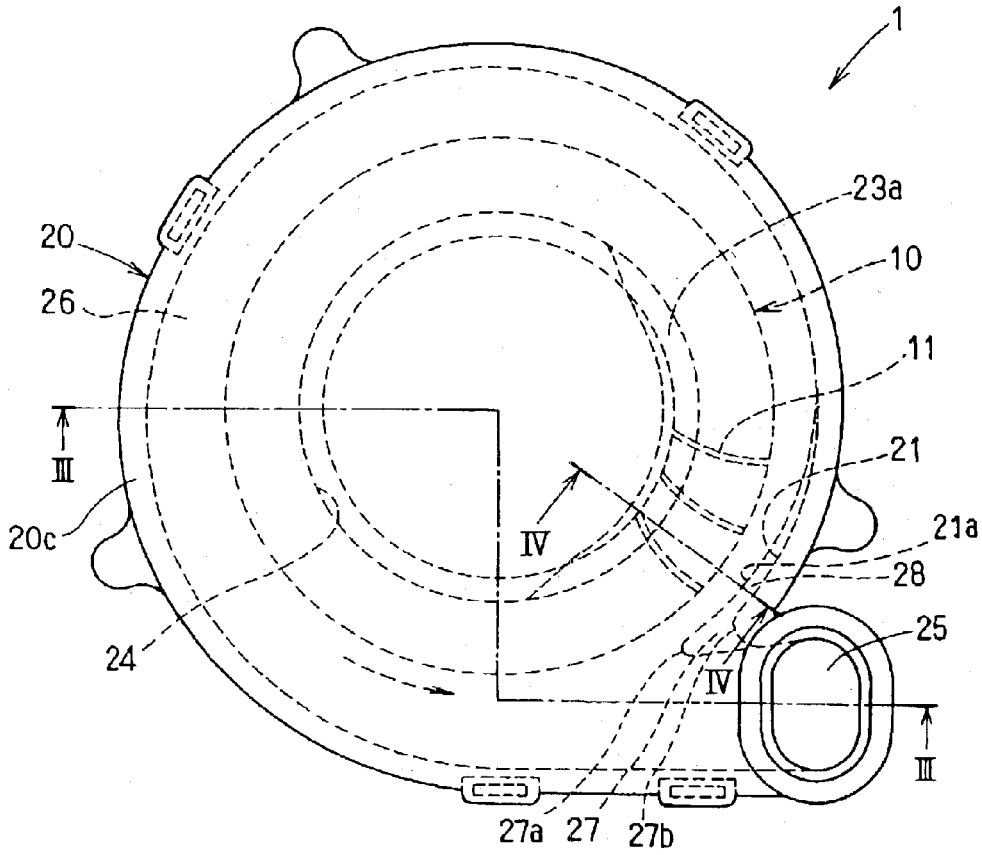
FIG. 2 is a plan view schematically showing the centrifugal blower according to the first embodiment of the present invention.
Figure 3:
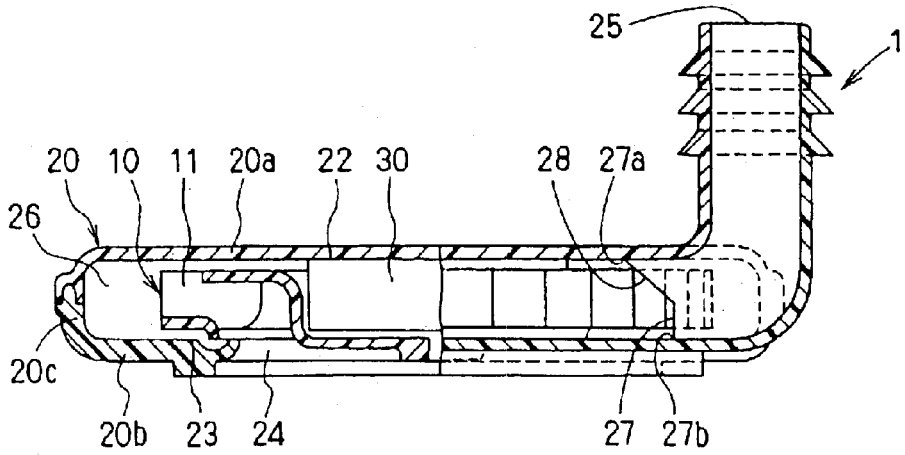
FIG. 3 is a cross sectional view along line III—III in FIG. 2.

With reference to FIGS. 2 and 3, the blower 1 includes a centrifugal fan (hereinafter, simply referred to as a fan) 10 and a scroll casing 20. The fan 10 is received in the scroll casing 20 and has a plurality of blades (in this instance, twenty seven blades are provided) 11, which are arranged at equal intervals along a circle. The scroll casing 20 has an air inlet 24, which is arranged adjacent to one axial end (located on the back side of the sheet of FIG. 2) of the fan 10. Upon rotation of the fan 10, the fan 10 axially draws air through the air inlet 24 and radially outwardly blows the drawn air. In FIG. 2, only some of the blades 11 are depicted, and the rest of the blades 11 is eliminated for the sake of clarity of the drawing.

As shown in FIG. 3, a motor 30 is arranged radially inward of the blades 11 in the scroll casing 20. The fan 10 is connected to a rotor of the motor 30 and is rotated by the motor 30. In the present embodiment, a brushless motor is used as the motor 30.

The scroll casing 20 forms a scroll air passage 26 around the fan 10. A passage cross sectional area of the scroll air passage 26 increases toward the air outlet 25 of the scroll casing 20. As shown in FIG. 3, the scroll casing 20 includes an upper casing part (first casing part) 20*a* and a lower casing part (second casing part) 20*b*, which are connected together. Each of the upper and lower casing parts 20*a*, 20*b* is made through molding of, for example, a polypropylene material in this instance.

The motor 30 is securely held in an inner top surface 22 of the scroll casing 20, which is a bottom surface (ceiling surface in FIG. 3) of the upper casing part 20*a*. The air inlet 24 is formed in an inner bottom surface (back side of the sheet of FIG. 2) 23 of the scroll casing 20, which is a bottom surface of the lower casing part 20*b*. Furthermore, a peripheral wall of the upper casing part 20*a* and a peripheral wall of the lower casing part 20*b* cooperate together to form a peripheral wall 20*c* of the scroll casing 20.

As shown in FIG. 2, the scroll casing 20 includes a protrusion 23*a*. The protrusion 23*a* protrudes radially inward from a peripheral edge of the air inlet 24 to partially cover the air inlet 24 at a location radially inward of a nose 27 that serves as an initial point of the scroll air passage 26. The nose 27 is formed in an inner surface 21 of the peripheral wall 20*c* and projects in a circumferential direction opposite to a rotational direction (the rotational direction is indicated by a dotted arrow in FIG. 2) of the centrifugal fan 10. At the nose 27, an outer peripheral section (i.e., outer radial ends of the blades 11) of the fan 10 is in the closest proximity to the inner surface 21 of the peripheral wall 20*c* of the scroll casing 20.

At the downstream end of the scroll air passage 26, the air outlet 25 is arranged. Upon installation of the blower 1 in the seat air conditioning system shown in FIG. 1, the air outlet 25 is communicated with the air passage 3 of the seat 2.

Figure 4:
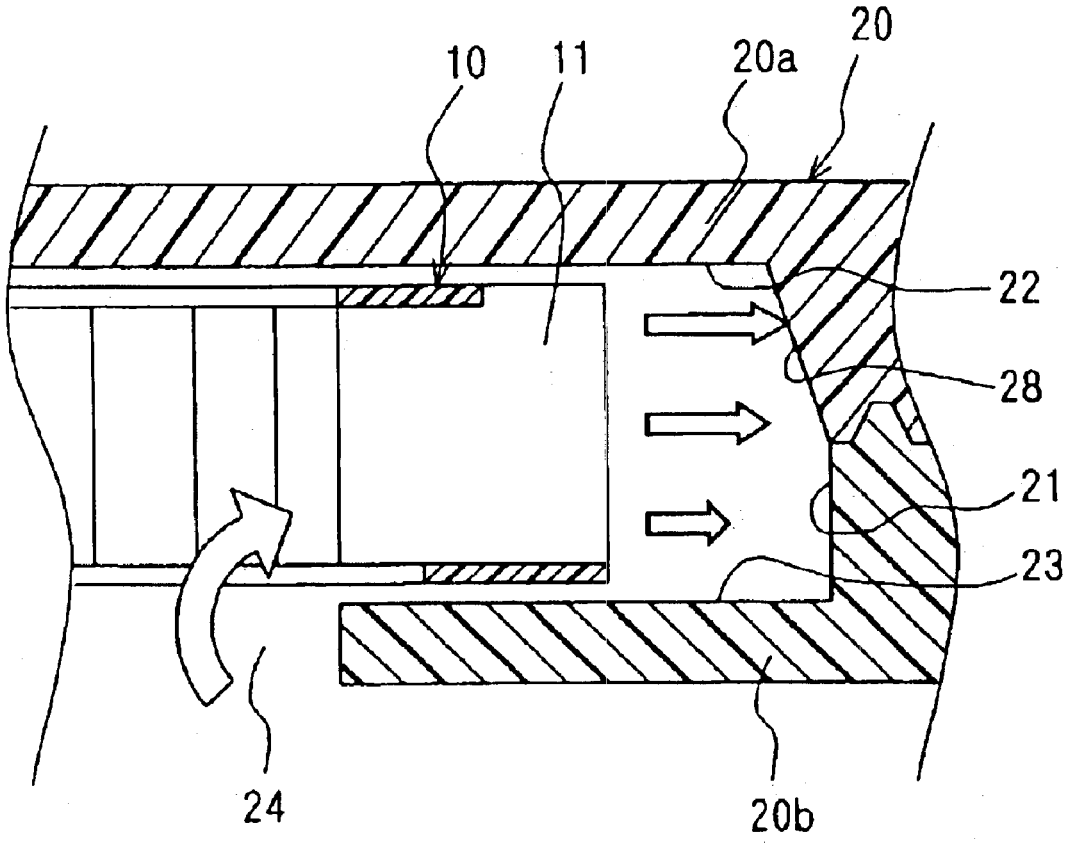
FIG. 4 is a cross sectional view along line IV—IV in FIG. 2.

A slant surface 28 is formed in an initial section 21*a* of the inner surface 21 of the peripheral wall 20*c* in radially opposed relationship to the blades 11 of the fan 10. The initial section 21*a* extends from a circumferentially projected end of the nose 27 toward the downstream side of the scroll air passage 26. The initial section 21*a* includes a region of the nose 27 and its adjacent region located downstream of the nose 27. However, it should be understood that the initial section 21*a* can only includes the region of the nose 27 in some cases. As shown in FIG. 4, only an upper half (upper half axial extent measured in a direction parallel to the rotational axis of the fan 10) of the initial section 21*a* of the inner surface 21 forms the slant surface 28 in this embodiment.

The slant surface 28 is angled relative to the rotational axis of the fan 10 in the following manner. That is, an axially remote part (serving as a first surface part) of the slant surface 28, which is axially remote from the air inlet 24, is radially closer to the blades 11 in comparison to an axially less remote part (serving as a second surface part) of the slant surface 28, which is axially less remote from the air inlet 24 in comparison to the axially remote part of the slant surface 28. Here, it should be noted that the axially remote part and the axially less remote part are used to indicate positional relationship of two axially separated parts, which are not radially equally spaced from the blades 11, in the initial section 21*a*. Also, the axially remote part and the axially less remote part overlap with each other in the direction parallel to the rotational axis of the fan 10.

The slant surface 28 is formed in the upper casing part 20*a* of the scroll casing 20. Thus, the slant surface 28 can be easily formed during the molding of the upper casing part 20*a* and allows easy removal of the slant surface 28 from a corresponding molding die after the molding.

As shown in FIG. 2, the slant surface 28 circumferentially extends to the circumferentially projected end of the nose 27, so that the projected end of the nose 27 is also slanted. As shown in FIGS. 2 and 3, in the upper half of the nose 27, an axially remote part (serving as a first surface part) of the nose 27, which is axially remote from the air inlet 24, is circumferentially arranged in front of an axially less remote part (serving as a second surface part) of the nose 27, which is axially less remote from the air inlet 24 in comparison to the axially remote part of the nose 27, in the circumferential direction opposite to the rotational direction (the rotational direction is indicated by the dotted arrow in FIG. 2) of the fan 10. In other words, the axially remote part of the nose 27 is arranged upstream of the axially less remote part of the nose 27 in the scroll air passage 26. Thus, with reference to FIGS. 2 and 3, an axially remote part (serving as a first surface part) 27*a* of the projected end of the nose 27, which is axially remote from the air inlet 24, is circumferentially arranged in front of an axially less remote part (serving as a second surface part) 27*b* of the projected end of the nose 27, which is axially less remote from the air inlet 24 in comparison to the axially remote part 27*a* of the projected end of the nose 27, in the circumferential direction opposite to the rotational direction of the fan 10.

In this way, in the scroll casing 20, a scroll angle of the axially less remote part (second surface part) of the initial section 21*a*, which is axially less remote from the air inlet 24 in comparison to the axially remote part (first surface part) of the initial section 21*a*, is smaller than a scroll angle of the axially remote part of the initial section 21*a*. Furthermore, a divergence angle of the axially less remote part of the initial section 21*a* is smaller than a divergence angle of the axially remote part of the initial section 21*a*.

Also, as shown in FIG. 2, the projected end of the nose 27 forms a curved surface, which extends over both the axially remote part 27*a* and the axially less remote part 27*b* and protrudes in the circumferential direction opposite to the rotational direction of the fan 10. A curvature of the curved surface in the axially remote part 27*a* of the projected end of the nose 27 is greater than a curvature of the curved surface in the axially less remote part 27*b* of the projected end of the nose 27.

Operation of the blower 1 will be described.

When the motor 30 is driven to rotate the fan 10, the blades 11 of the fan 10 are rotated to draw air into the interior of the scroll casing 20 through the air inlet 24. The air drawn into the scroll casing 20 through the air inlet 24 is radially outwardly pushed (i.e., is blown) and is guided along the scroll air passage 26. At this stage, a velocity of the airflow (or wind) pushed, or blown, by the blade 11 is influenced by airflow drawn through the air inlet 24. Thus, as shown in FIG. 4, an airflow component of the airflow adjacent to the inner top surface 22 of the scroll casing 20, which is axially remote from the air inlet 24, has a velocity (first velocity) higher than a velocity (second velocity) of an airflow component of the airflow adjacent to the inner bottom surface 23 of the scroll casing 20, which is axially less remoter from the air inlet 24 in comparison to the inner top surface 22 of the scroll casing 20.

However, as described above, in the initial section 21*a* of the inner surface 21 of the peripheral wall 20*c*, which includes the surface of the nose 27 and its adjacent region, the slant surface 28 is formed as follows. That is, in the initial section 21*a* of the inner surface 21 of the peripheral wall 20*c*, the axially remote part (first surface part), which is axially remote from the air inlet 24 and receives the airflow component of the higher velocity (first velocity), is radially closer to the blades 11 in comparison to the axially less remote part (second surface part), which is axially less remote from the air inlet 24 in comparison to the axially remote part and receives the airflow component of the lower velocity lower than the higher velocity described above. Thus, a time interval between time of impingement of the airflow component of the higher velocity against the inner surface 21 and time of impingement of the airflow component of the lower velocity against the inner surface 21 is lengthened in comparison to the prior art case where the axially remote part and the axially less remote part are equally radially spaced from the blades. In other words, in the present embodiment, it takes more time for all of the wind component of the higher velocity and the wind component of the lower velocity to impinge against the inner surface 21 of the peripheral wall 20*a* of the scroll casing 20 in comparison to the prior art.

As described above, it takes more time for all of corresponding airflow components of the airflow, which is blown radially outward by the single blade 11 toward the inner surface 21 of the peripheral wall 20*a*, to completely impinge against the inner surface 21 of the peripheral wall 20*a*. Thus, the siren-like noises, which are generated at the time of impingement of the airflow against the inner surface 21 of the peripheral wall 20*a*, are accordingly reduced in the present embodiment. After the airflow blown by the blade 11 impinges the inner surface 21 of the scroll casing 20, the airflow is guided by the inner surface 21 along the scroll air passage 26 toward the air outlet 25.

Also, a portion of the airflow blown by the blade 11 impinges the projected end of the nose 27. However, the axially remote part 27*a* (first surface part) of the projected end of the nose 27, which is axially remote from the air inlet 24 and receives the airflow component of the higher velocity, is located upstream of the axially less remote part (second surface part) 27*b* of the projected end of the nose 27, which is axially less remote from the air inlet 24 in comparison to the axially remote part 27*a* of the projected end of the nose 27 and receives the airflow component of the lower velocity. Thus, a time interval between time of impingement of the airflow component of the higher velocity against the projected end of the nose 27 and time of impingement of the airflow component of the lower velocity against the projected end of the nose 27 is lengthened in comparison to the prior art case where the entire projected end of the nose 27 axially extends parallel to the rotational axis of the fan 10. Thus, in the present embodiment, the siren-like noises are reduced at the projected end of the nose 27 in comparison to the prior art.

With the above arrangement, the noises of the airflow blown by the corresponding blade 11 can be advantageously reduced. This noise reduction effect is achieved every time respective blade 11 passes the initial section 21*a* of the inner surface 21 of the peripheral wall 20*c*, which includes the nose 27 and its adjacent region. Thus, the annoying siren-like noises can be advantageously reduced. In the above arrangement, the slant surface 28 is simply formed in the initial section 21*a* of the inner surface 21, which includes the surface of the nose 27 and its adjacent surface region, so that a size of the blower 1 is not substantially increased.

Furthermore, although the slant surface 28 is only provided in the initial section 21*a* of the inner surface 21 and is not provided downstream of the initial section 21*a* of the inner surface 21, generation of the siren-like noises is restrained at the downstream region located downstream of the initial section 21*a* due to the following reason. That is, a distance between the blades 11 and the inner surface 21 is increased in the downstream region in comparison to the initial section 21*a*, so that the velocity of airflow blown by the corresponding blade 11 is substantially reduced to restrain generation of the noises caused by the impingement of the airflow against the inner surface 21.

Furthermore, as shown in FIG. 3, the slant surface 28 linearly extends to the projected end of the nose 27. Also, as described above, the curvature of the curved surface of the axially remote part 27*a* of the projected end of the nose 27 is greater than the curvature of the curved surface of the axially less remote part 27*b* of the projected end of the nose 27. Thus, when a portion of the airflow, which flows in the scroll air passage 26, approaches the air outlet 25, that portion of the airflow is effectively divided or guided at the nose 27 and is recirculated through the scroll air passage 26. At that time, this airflow is not agitated by the nose 27 and thus flows smoothly. In this way, generation of the noises by the recirculated airflow is also advantageously restrained.

Furthermore, in the blower 1, the motor 30 is arranged radially inward of the blades 11, which are arranged along the circle in the scroll casing 20. With this arrangement, the size of the blower 1 can be made more compact in comparison to a case where the motor 30 is arranged outside the scroll casing 20. In addition, since the motor 30 is received in the scroll casing 20, it is possible to further restrain leakage of noises generated by the motor 30 in comparison to the case where the motor 30 is arranged outside the scroll casing 20.

Figure 5A:
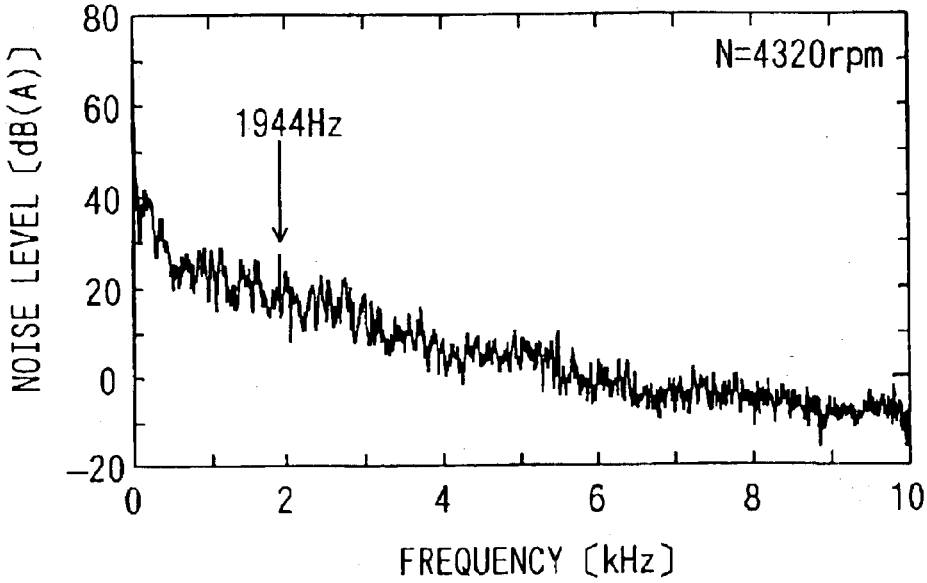
FIG. 5A is a graph showing frequency characteristics of noise levels of the centrifugal blower.
Figure 5B:
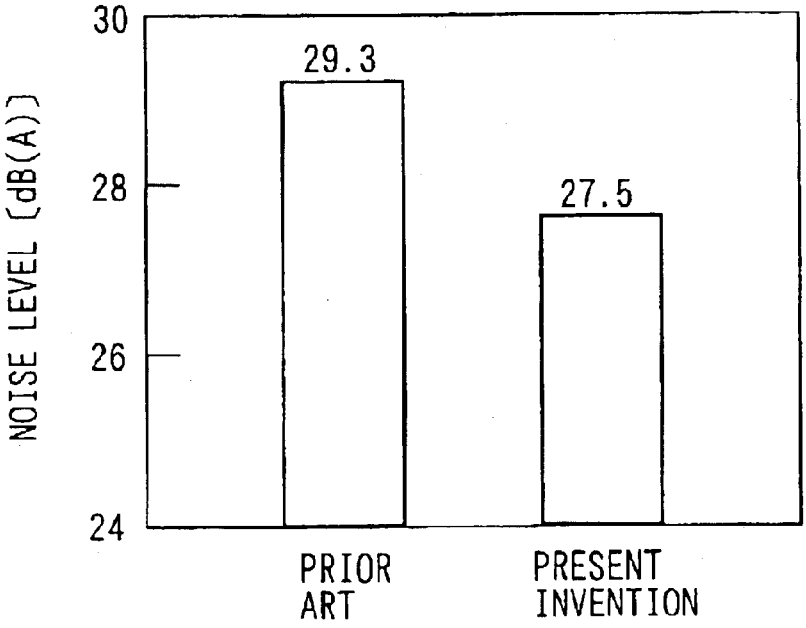
FIG. 5B is a graph showing comparison of a noise level of a prior art blower and a noise level of the blower of the first embodiment.

FIGS. 5A and 5B are graphs showing result of evaluation of the blower 1. The blower 1 is evaluated in the following manner. That is, the blower 1 is arranged at the bottom of the vehicle seat, and the motor 30 is rotated at a rotational speed of approximately 4,320 rpm. A microphone is arranged at a predetermined position that corresponds to a position of an ear of a user seating on the vehicle seat, and a noise level is measured through the microphone.

FIG. 5A shows frequency characteristics of the noise levels. A frequency, which corresponds to the number of blades 11 passing the nose 27, is calculated based on the rotational speed of the fan 10 and the number of blades 11 and is determined to be 1,944 Hz. FIG. 5B shows noise levels of the prior art blower and of the blower 1 of the present embodiment at this frequency. The noise level of the blower 1 of the present embodiment is about 27.5 dB(A).

Contrary to this, in the prior art blower, which has the structure similar to that of the blower 1 of the present embodiment except that the slant surface 28 is not provided in the scroll casing of the prior art blower, the noise level observed at the above frequency is 29.3 dB(A). That is, the noise level of the blower 1 of the present embodiment is substantially reduced in comparison to the blower of the prior art, and the siren-like noises are reduced to the level that is difficult to hear.

(Second Embodiment)

A second embodiment of the present invention will be described with reference to the drawings.

Figure 6:
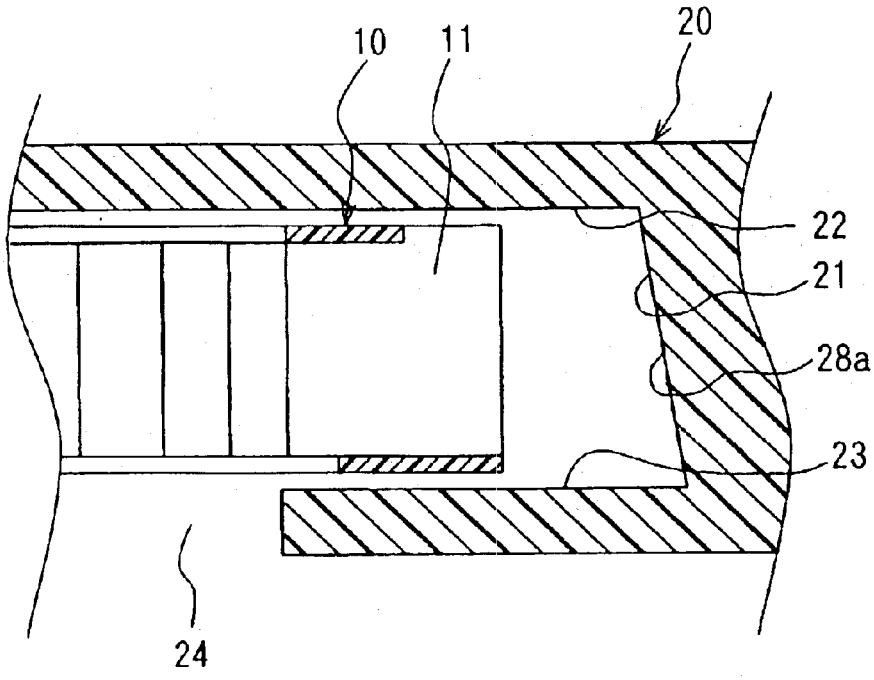
FIG. 6 is a partial schematic cross sectional view of a centrifugal blower according to a second embodiment of the present invention.

In the second embodiment, the shape of the scroll casing differs from that of the first embodiment. Components similar to those discussed with reference to the first embodiment will be indicated by the same numerals. With reference to FIG. 6, in the scroll casing 20 of the present embodiment, a slant surface 28*a*, which is angled relative to the rotational axis of the fan 10, is formed along an entire axial extent of the initial section 21*a* of the inner surface 21 of the peripheral wall 20*c*.

An axially remote part (first surface part) of the slant surface 28*a*, which is axially remote from the air inlet 24 and receives the airflow component of the higher velocity, is radially closer to the blades 11 in comparison to an axially less remote part (second surface part), which is axially less remote from the air inlet 24 in comparison to the axially remote part and receives the airflow component of the lower velocity lower than the airflow component of the lower velocity.

Even with this arrangement, the advantages similar to the first embodiment can be achieved. However, in the second embodiment, the slant surface 28*a* is formed along the entire axial extent of the initial section 21*a* of the inner surface 21, as shown in FIG. 6. Thus, in comparison to the first embodiment, it takes more time for all of corresponding airflow components of the airflow, which is blown radially outward by the single blade 11 toward the inner surface 21 of the scroll casing 20, to completely impinge against the inner surface 21. Thus, the siren-like noises, which are generated at the time of impingement of the airflow against the inner surface 21 of the peripheral wall 20*c* of the scroll casing 20, are accordingly further reduced.

Figure 7:
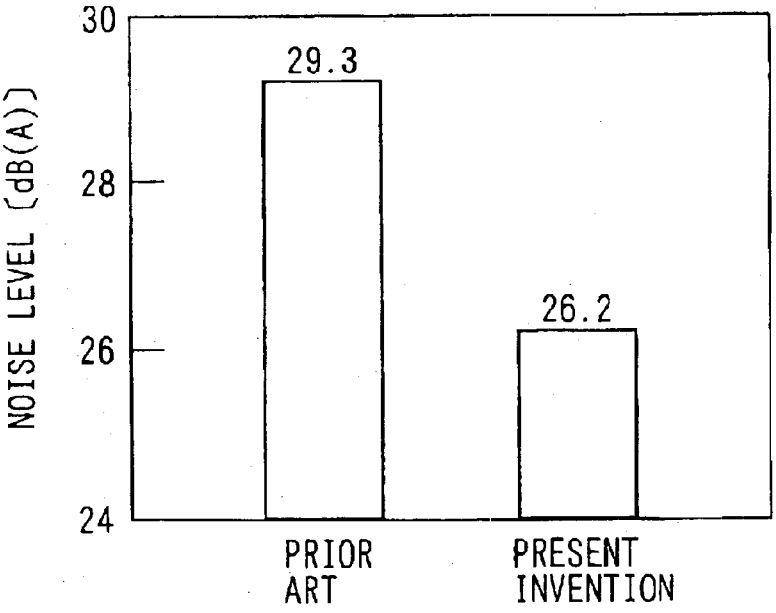
FIG. 7 is a graph showing comparison of the noise level of the prior art blower and a noise level of the blower of the second embodiment.

FIG. 7 shows a result of the evaluation of the noises of the blower. The evaluation is performed in a manner similar to that of the first embodiment. As shown in FIG. 7, the noise level of the blower of the present embodiment at 1,944 Hz is 26.2 dB(A), which shows a substantial reduction of the noises in comparison to the prior art.

(Third Embodiment)

A third embodiment of the present invention will be described with reference to the drawings.

A structure of the scroll casing of the third embodiment differs from that of the first embodiment. In the third embodiment, components similar to those of the first or second embodiment will be indicated by the same numerals and will not be described further.

Figure 8:
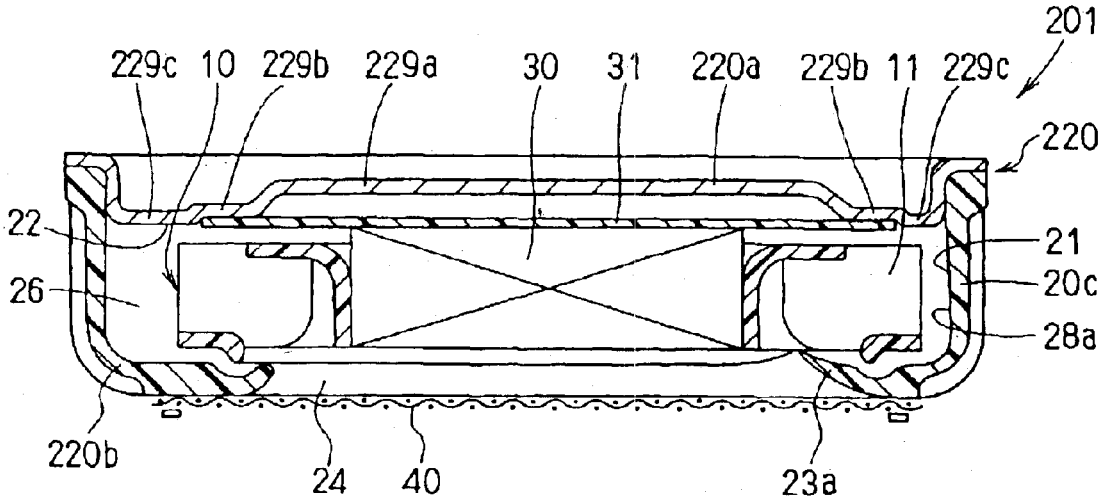
FIG. 8 is a schematic cross sectional view of a centrifugal blower according to a third embodiment of the present invention.

FIG. 8 is a cross sectional view schematically showing a structure of a blower 201 according to the present embodiment. In FIG. 8, there is shown a cross sectional area of the blower 201 along an imaginary plane that includes a rotational axis of the fan 10 of the blower 201 and the nose of the scroll casing 220 of the blower 201, and the air outlet 25 and the air passage connected to the air outlet 25 are eliminated.

As shown in FIG. 8, the blower 201 has the fan 10 similar to that of the first embodiment. The motor 30 is arranged radially inward of the blades 11. The fan 10 is connected to the rotor of the motor 30. A numeral 31 indicates a circuit board, in which a drive circuit for driving the motor 30 is arranged. A stator of the motor 30 is securely held at a lower surface of the circuit board 31. Elements, which constitute a part of the drive circuit, are arranged on a top surface of the circuit board 31. However, these elements are not depicted for the sake of the simplicity.

The scroll casing 220 is arranged around the fan 10 and forms the scroll air passage 26, which extends around the fan 10 and has a passage cross sectional area that increases toward the air outlet 25 (not shown in FIG. 8). The scroll casing 220 includes an upper metal casing part (first casing part) 220*a* and a lower resin casing part (second casing part) 220*b*. The resin casing part 220*b* is made by molding an electrically conductive resin material, which includes metal fibers.

As shown in FIG. 8, the metal casing part 220*a*, which is in a form of a metal cover, includes first to third steps 229*a*–229*c* arranged radially inward of an outer peripheral engaging part that engages the lower resin casing part 220*b*. The circuit board 31 is engaged with the second step 229*b* and is thus secured to the metal casing part 220*a*. The metal casing part 220*a* covers the circuit board 31 such that the first step 229*a* of the metal casing part 220*a* covers the elements (not shown) of the circuit board 31. The third step 229*c* of the metal casing part 220*a* and the circuit board 31 form the inner top surface 22 of the scroll casing 220.

Similar to the second embodiment, the slant surface 28*a* is formed along an entire axial extent of the initial section 21*a* of the inner surface 21 of the peripheral wall 20*c*, which includes the region of the nose and its peripheral region. A metal mesh 40 made of stainless steel is secured through threadable engagement to a bottom surface of the resin casing part 220*b* to cover the air inlet 24.

With the above structure, the third step 229*c* of the metal casing part 220*a*, the circuit board 31 and the resin casing part 220*b* form the scroll casing 220, in which the scroll air passage 26 is formed. By forming the circuit board 31 as a part of the scroll casing, the size of the blower 201 can be reduced in comparison to the case where the circuit board 31 is arranged outside the scroll casing.

Furthermore, similar to the second embodiment, the scroll casing 220 of the present embodiment includes the slant surface 28*a*, so that the siren-like noises generated upon impingement of the airflow blown by the corresponding blade 11 against the inner surface 21 can be advantageously reduced.

As described above, the scroll casing 220 includes the metal casing part 220*a* and the resin casing part 220*b* made of the electrically conductive resin material, and the metal mesh 40 is arranged in the resign casing part 220*b* to cover the air inlet 24. Thus, leakage of electromagnetic waves generated by the motor 30 or the circuit board 31, which includes the various elements (not shown), can be advantageously restrained. Furthermore, erroneous activation of the motor 30 by externally generated electromagnetic waves can be restrained. Also, the metal mesh 40 can restrain entrance of foreign debris or objects into the air inlet 24.

In the present embodiment, although each of the metal casing part 220*a*, the resign casing part 220*b* and the metal mesh 40 is made of the corresponding electrically conductive material, the conductive material can be only partially used in these components to meet a correspond demand for shielding the electromagnetic waves. For example, in the present embodiment, the resin casing part 220*b* can be made of a dielectric resin material, which does not contain an electrically conductive material.

Furthermore, the metal casing part 220*a* covers the top side of the motor 30 and the top side of the circuit board 31. Thus, even when water droplets or any other liquid droplets are spilled over the metal casing part 220*a*, it is possible to restrain the liquid droplets from reaching the motor 30 or the drive circuit.

(Other Embodiments)

Figure 9:
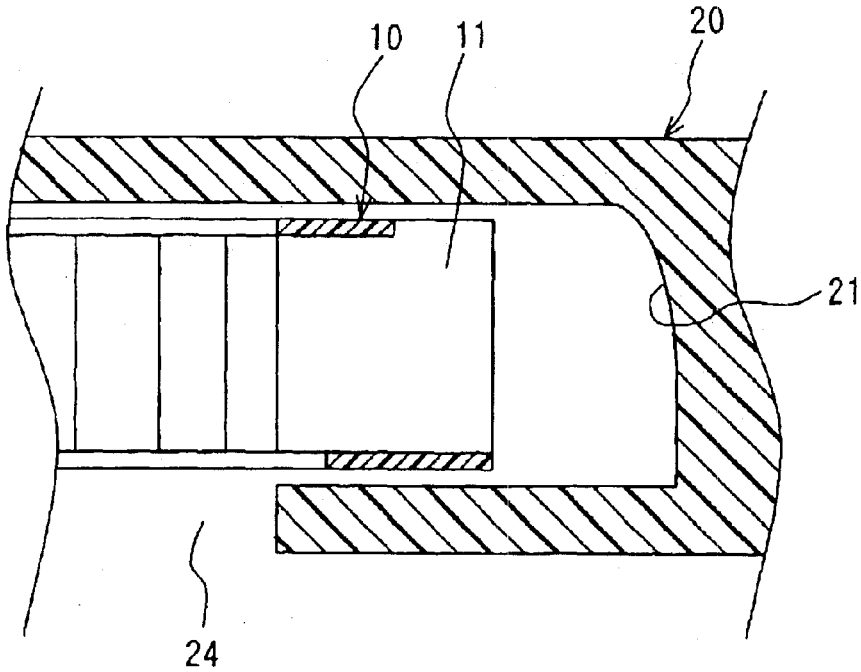
FIG. 9 is a partial schematic cross sectional view of a modification of the centrifugal blower of the second embodiment.
Figure 10:
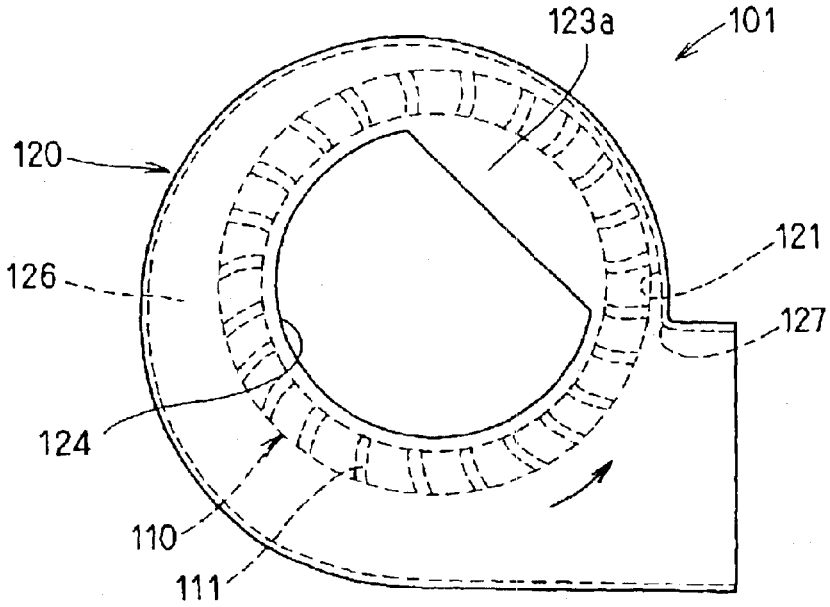
FIG. 10 PRIOR ART
FIG. 10 is a schematic plan view of the prior art centrifugal blower.
Figure 11:
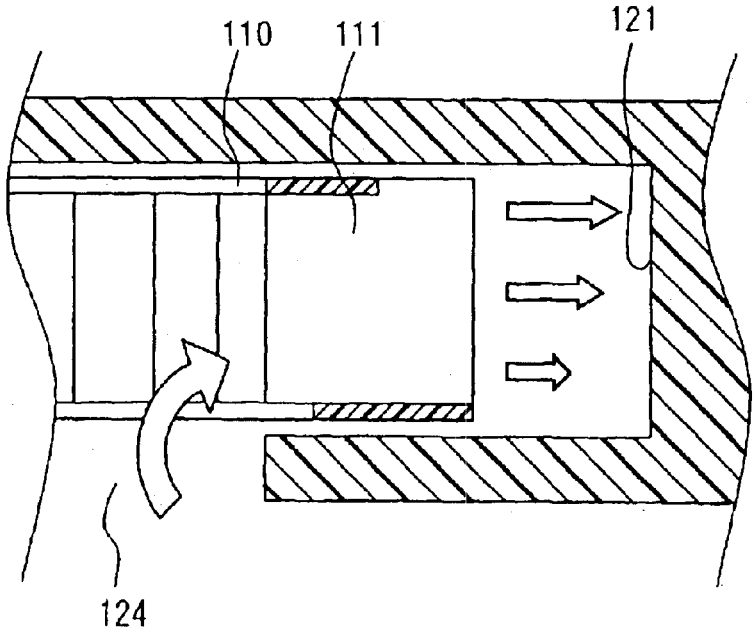
FIG. 11 PRIOR ART
FIG. 11 is a partial schematic cross sectional view of the prior art centrifugal blower.

In the above embodiments, the slant surfaces 28, 28*a* linearly extends generally in the rotational direction of the fan 10. Alternatively, as long as the axially remote part, which is axially remote from the air inlet 24 and receives the airflow component of the higher velocity, is radially closer to the blades 11 in comparison to the axially less remote part, which is axially less remote from the air inlet 24 in comparison to the axially remote part and receives the airflow component of the lower velocity lower than the higher velocity described above, the slant surface 28, 28*a* can be formed in any other form. For example, as shown in FIG. 9, the slant surface can be formed as a curved surface, which is curved in the direction parallel to the rotational axis of the fan 10.

Furthermore, in each of the above embodiments, the slant surface 28, 28*a* is formed only in the initial section (the initial section has an angular extent of about 60 degrees about the rotational axis of the fan 10 as shown in FIG. 2) 21*a* of the inner surface 21 of the peripheral wall 20*c* of the scroll casing 20, 220. However, the present invention is not limited to this. For example, according to the characteristics of the blower, such as shape and size of the scroll air passage 26, the angular extent of the slant surface can be changed to any appropriate one as long as the nose 27 is included in the slant surface.

Furthermore, the slant surface 28 is formed in the upper half of the inner surface 21 of the peripheral wall 20*c* in the first embodiment. Also, the slant surface 28*a* is formed along the entire axial extent of the inner surface 21 of the peripheral wall 20*c*. The axial extent of the slant surface is not limited to these. However, when the scroll casing is made of more than one component, and the component, in which the slant surface is formed, is made by molding of the corresponding material using the corresponding die, it is preferred to provide the slant surface at a corresponding position that does not cause overhanging of the slant surface from the component. In this way, the manufacturing of the scroll casing, which includes the slant surface, is eased.

Furthermore, in each of the above embodiments, the smooth slant surface 28, 28*a* is formed in the inner surface 21 in such a manner that the axially remote part, which is axially remote from the air inlet 24 and receives the airflow component of the higher velocity, is radially closer to the blades 11 in comparison to the axially less remote part, which is axially less remote from the air inlet 24 in comparison to the axially remote part and receives the airflow component of the lower velocity lower than the higher velocity described above. However, the slant surface 28, 28*a* is not limited to the above arrangement. As long as the axially remote part, which is axially remote from the air inlet 24 and receives the airflow component of the higher velocity, is radially closer to the blades 11 in comparison to the axially less remote part, which is axially less remote from the air inlet 24 in comparison to the axially remote part and receives the airflow component of the lower velocity, the slant surface can have any suitable shape that does not cause generation of vortex airflow, which could generate noises. For example, the slant surface can have a plurality of steps.

Also, it should be noted that the axially remote part (first surface part), which receives and guides the airflow component of the higher velocity (first velocity), and the axially less remote part (second surface part), which receives and guides the airflow component of the lower velocity (second velocity), are only used to indicate the positional relationship between the two axially separated parts, which are not radially equally spaced from the blades 11, in the initial section 21*a* of the inner surface 21 of the peripheral wall 20*c* and are thus not limited to the particular parts depicted in the above embodiments. In other words, the axially remote part and the axially less remote part can be any other axially separated appropriate parts, which are not radially equally spaced from the blades 11, in the initial section 21*a* of the inner surface 21 of the peripheral wall 20*c* as long as the axially remote part is located axially further apart from the air inlet 24 in comparison to the axially less remote part. Furthermore, in the above embodiments, the axially remote part is also referred to as the first surface part, which receives and guides the airflow component of the higher velocity, and the axially less remote part is also referred to as the second surface part, which receives and guides the airflow component of the lower velocity. However, as long as the first surface part of the initial section 21*a* receives and guides the airflow component of the higher velocity, and the second surface part of the initial section 21*a* receives and guide the airflow component of the lower velocity that is lower than the higher velocity, the first surface part can be axially located closer to the air inlet 24 in comparison to the second surface part in a case where the airflow component of the higher velocity is axially located closer to the air inlet 24 in comparison to the airflow component of the lower velocity.

Additional advantages and modifications will readily occur to those skilled in the art. The invention in its broader terms is therefore not limited to the specific details, representative apparatus, and illustrative examples shown and described.

What is claimed is:

1. A centrifugal blower comprising:

a centrifugal fan that has a plurality of blades, which are generally arranged along a circle, wherein the centrifugal fan axially draws air and radially blows the drawn air;

a motor that rotates the centrifugal fan; and a scroll casing that surrounds the centrifugal fan and includes:

an air inlet that is arranged adjacent to one axial end of the centrifugal fan to supply air to the centrifugal fan; and a scroll air passage that extends around the centrifugal fan along an inner surface of a peripheral wall of the scroll casing, wherein:

a nose, which is formed in the inner surface of the peripheral wall and projects in a circumferential direction opposite to a rotational direction of the centrifugal fan, forms an initial point of the scroll air passage;

the inner surface of the peripheral wall includes an initial section, which extends from a circumferentially projected end of the nose, wherein the initial section of the inner surface includes:

a first surface part that receives and guides a first airflow component of airflow that is radially blown by a corresponding one of the blades, wherein the first airflow component has a first velocity; and a second surface part that receives and guides a second airflow component of the airflow that is radially blown by the corresponding one of the blades, wherein the second airflow component has a second velocity that is smaller than the first velocity;

the first surface part and the second surface part at least partially overlap with each other in a direction generally parallel to a rotational axis of the centrifugal fan; and the first surface part is radially closer to the blades in comparison to the second surface part.

2. A centrifugal blower according to claim 1, wherein the initial section of the inner surface includes a slant surface that is angled relative to the rotational axis of the centrifugal fan.

3. A centrifugal blower according to claim 1, wherein the circumferentially projected end of the nose includes:

a first segment that forms at least a portion of the first surface part; and a second segment that forms at least a portion of the second surface part, wherein the first segment is located upstream of the second segment in the scroll air passage.

4. A centrifugal blower according to claim 3, wherein:

the circumferentially projected end of the nose forms a curved surface, which extends over both the first segment and the second segment and protrudes in the circumferential direction opposite to the rotational direction of the centrifugal fan; and a curvature of the curved surface in the first segment is larger than a curvature of the curved surface in the second segment.

5. A centrifugal blower according to claim 1, wherein the second surface part is axially closer to the air inlet in comparison to the first surface part.

6. A centrifugal blower according to claim 2, wherein the slant surface is formed along about one half of an axial extent of the initial section.

7. A centrifugal blower according to claim 2, wherein the slant surface is formed along a substantially entire axial extent of the initial section.

8. A centrifugal blower according to claim 1 further comprising a circuit board that is received inside the scroll casing and includes a drive circuit for driving the motor, wherein the scroll casing includes a metal cover that covers the circuit board.

9. A centrifugal blower according to claim 1, wherein the motor is arranged radially inward of the blades within the scroll casing.

10. A centrifugal blower according to claim 1, wherein at least a portion of the scroll casing is made of an electrically conductive material.

11. A centrifugal blower according to claim 1, wherein a scroll angle of the first surface part is smaller than a scroll angle of the second surface part.

12. A centrifugal blower according to claim 1, wherein a divergence angle of the first surface part is smaller than a divergence angle of the second surface part.

13. A centrifugal blower according to claim 1, wherein an angular extent of the initial section is about 60 degrees about the rotational axis of the centrifugal fan.

* * * * *